US007231675B1

(12) United States Patent
Rucinski et al.

(10) Patent No.: US 7,231,675 B1
(45) Date of Patent: Jun. 19, 2007

(54) PULL DOWN BED

(75) Inventors: Thadeus Rucinski, Chicago, IL (US); Patrick D. Tracy, Chicago, IL (US); Laura A. Peters, Naperville, IL (US); Matthew Zywica, Crestwood, IL (US)

(73) Assignee: tedbed Company, Chicago, IL (US)

( * ) Notice: Subject to any disclaimer, the term of this patent is extended or adjusted under 35 U.S.C. 154(b) by 0 days.

(21) Appl. No.: 11/278,065

(22) Filed: Mar. 30, 2006

(51) Int. Cl.
*A47C 17/38* (2006.01)
*A47C 17/52* (2006.01)

(52) U.S. Cl. ..... 5/136; 5/160; 5/162

(58) Field of Classification Search ..... 5/133, 5/136, 160, 162, 159.1, 663, 907
See application file for complete search history.

(56) References Cited

U.S. PATENT DOCUMENTS

| | | | | | |
|---|---|---|---|---|---|
| 187,454 | A | * | 2/1877 | Caulier | 5/144 |
| 659,131 | A | * | 10/1900 | Burgett | 5/162 |
| 800,874 | A | * | 10/1905 | James | 15/65 |
| 1,057,191 | A | | 3/1913 | Welsh | |
| 1,171,971 | A | | 2/1916 | Murphy | |
| 1,218,202 | A | | 3/1917 | Murphy | |
| 1,350,720 | A | | 8/1920 | Ghittino | |
| 1,624,222 | A | | 4/1927 | Duvall | |
| 1,683,149 | A | | 9/1928 | Ball | |
| 1,693,795 | A | * | 12/1928 | Moore | 5/146 |
| 1,820,672 | A | | 8/1931 | Muchlinski | |
| 1,837,211 | A | | 12/1931 | Duvall | |
| 1,876,327 | A | | 9/1932 | Lauterstein | |
| 2,671,230 | A | | 3/1954 | Potter | |
| 2,863,157 | A | * | 12/1958 | Martin | 5/510 |
| 3,464,070 | A | | 9/1969 | Driver | |
| 3,550,167 | A | | 12/1970 | Bennett | |
| 3,805,307 | A | | 4/1974 | Foufounis et al. | |
| 3,846,852 | A | | 11/1974 | Mercier | |
| 4,370,766 | A | | 2/1983 | Teague, Jr. | |
| 4,466,147 | A | | 8/1984 | Yokoi et al. | |
| 4,694,518 | A | | 9/1987 | Lukich et al. | |
| 4,793,011 | A | | 12/1988 | Eve | |
| 4,885,813 | A | | 12/1989 | McNamara | |
| 5,033,134 | A | | 7/1991 | Burchett | |
| 5,101,523 | A | | 4/1992 | Bright | |
| 5,446,932 | A | * | 9/1995 | Voorhis | 5/137 |
| 5,978,988 | A | | 11/1999 | Burchett | |
| 6,105,185 | A | | 8/2000 | DiRocco | |
| 6,175,975 | B1 | | 1/2001 | Bottcher et al. | |
| 6,691,342 | B2 | | 2/2004 | Sherman | |
| 7,100,228 | B2 | * | 9/2006 | Polevoy et al. | 5/663 |
| 2001/0044960 | A1 | | 11/2001 | Schwalbe, Jr. | |

* cited by examiner

*Primary Examiner*—Michael Trettel
(74) *Attorney, Agent, or Firm*—Clausen Miller, PC

(57) ABSTRACT

A pull down bed that pivots from a vertical, stow away position to a horizontal position for use when sleeping is provided. Weight bearing leg panels are hingedly attached to the mattress platform and swing downward and away from the platform sides when the bed is lowered. A headboard is slidably mounted on parallel horizontal rails and can slide forward when the bed is lowered to present the look of a traditional bed.

7 Claims, 6 Drawing Sheets

PULL DOWN BED

BACKGROUND

1. Field of the Invention

This patent relates to furniture. More particularly, this patent relates to a bed of the type that may be stored in an upright, vertical position and then pulled down to a horizontal position when needed for use.

2. Description of the Related Art

Traditional "Murphy" type beds that can be stored in an upright, vertical position and then pulled down to a horizontal position when needed for use are well known in the art. William Murphy began obtaining patents on his "folding bed" in the early 20th century, and the concept of a pull down bed has been evolving ever since. For example, U.S. Pat. No. 1,837,211 discloses a folding bed that may be folded into a closest. U.S. Pat. No. 1,876,327 discloses a folding bed that hangs on a pivoting closet door. U.S. Pat. No. 2,671,230 discloses a folding wall bed that also functions as a desk. A number of folding bed patents discloses various ways to enable the bed to be easily raised and lowered, including U.S. Pat. No. 4,466,147 (counterbalance springs). U.S. Pat. No. 5,978,988 (counterbalance piston), U.S. Pat. No. 6,105,185 (counterbalance spring) and U.S. Published Patent Application No. US2001/0044960 (fluid counterweights).

Many of these and other folding beds include an "above-bed" support structure that can be seen above and behind the bed when it is in the down (use) position. It is an object of the present invention to provide a pull down bed which does not have an above-bed support structure so that the bed in the down position has the look of a traditional, everday bed.

Many conventional pull down beds have an exposed metal frame when in the down position, which can be unsightly. The present invention solves that problem by providing ornamental panels that snap onto the sides and foot end of the bed frame to hide the frame and provide a look more like a traditional, everyday bed. The ornamental panels can be switched out to provide different decorative looks.

A further advantage of the present invention is that it provides load bearing leg panels that swing down to support the bed in its down position. The leg panels can be made from wood or covered with wood veneer to improve the appearance of the bed.

Still another advantage of the present invention is that it provides a pull down bed having a headboard that can slide forward when the bed is in the down position so that the pull down bed looks even more like a traditional, everyday bed.

Further and additional objects will appear from the description, accompanying drawings, and appended claims.

SUMMARY OF THE INVENTION

The present invention is a pull down bed having the look of a traditional bed when in the down (sleeping) position. The mattress platform is pivotally attached to a stationary base so that the mattress platform can be raised and lowered between a vertical, stowaway position and a horizontal, use position. The base is mounted to a wall or floor.

A pair of leg panels are hingedly attached to the lower surface of the mattress platform such that each leg panel can pivot about an axis parallel to the mattress platform sides between a folded, stowaway, position and a vertical, use position and lock when at a 90 degree angle to the platform. The leg panels are load bearing when in the vertical position.

One or more rails are attached to a horizontal panel that forms part of the stationary base. A headboard is slidably mounted on the rails such that it can slide horizontally along the rails, independent of the mattress platform, between a rearward position when the mattress platform is raised and a forward position when the mattress platform is lowered and give the mattress platform an attractive floating appearance.

Cosmetic panels can be attached to the sides and foot of the mattress platform for aesthetic purposes. The pull down bed has no "above-bed" support structure that can be seen above and behind the bed when it is in the down (use) position. Consequently, when the bed is in the down position it has the look of a traditional, everyday bed.

DRAWINGS

FIGS. 1 and 1*a* are perspective views of a pull down bed according to the present invention in thelowered (use) position shown with and without a mattress.

FIG. 2 is a perspective view of the mattress platform portion of the pull down bed of FIG. 1 in the raised (stored) position, shown without a decorative snap-on panel.

FIGS. 3 and 3*a* are perspective views of the mattress platform portion of FIG. 2 shown with a decorative snap-on panel about to be installed.

FIG. 5 is a side perspective view of the pull down bed of FIG. 1 in the raised (stored) position with the leg panels folded in.

Figures 1, 1A:
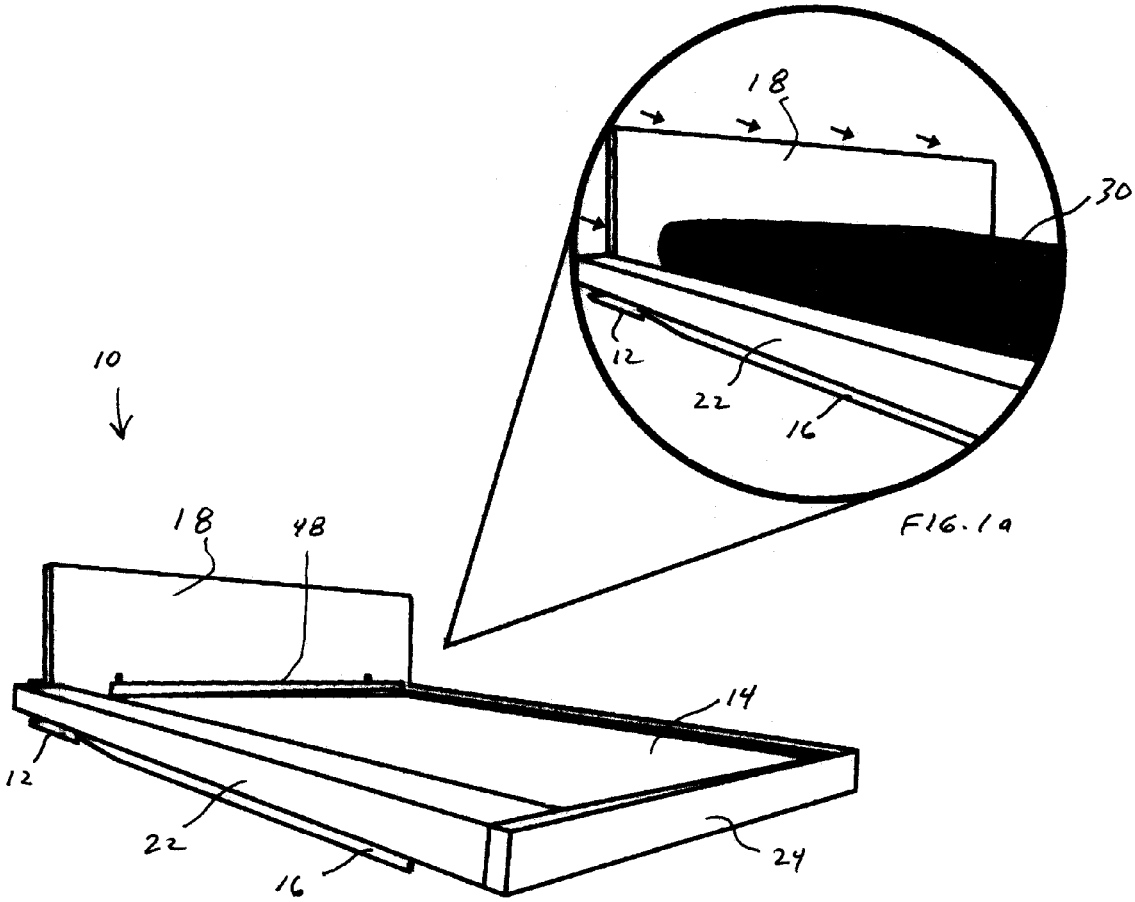
Figure 8:
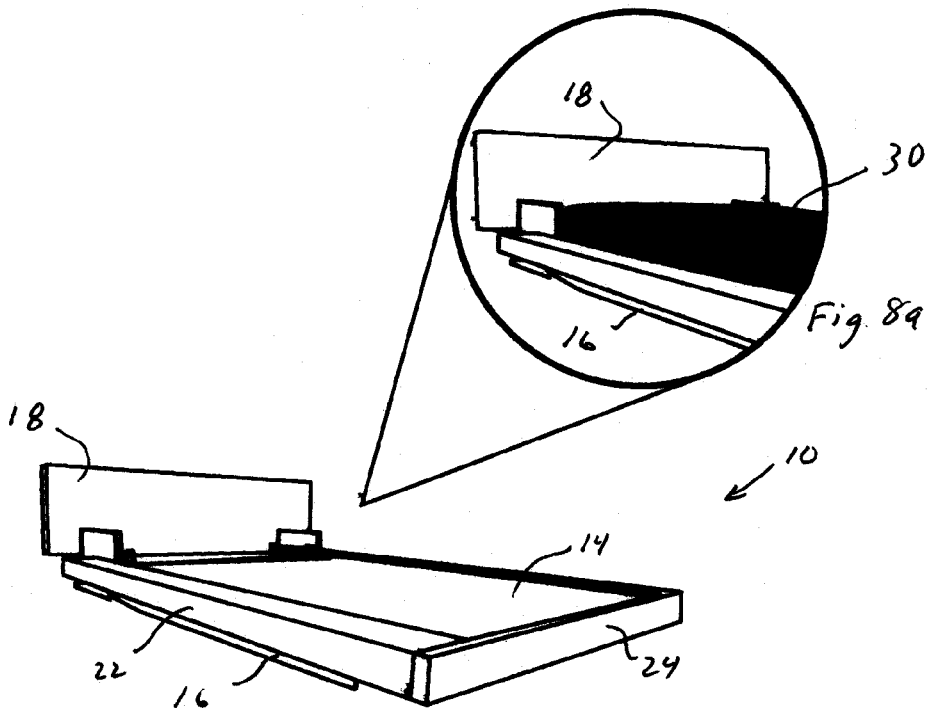

FIGS. 8 and 8*a* are perspective views of the pull down bed of FIG. 1 shown with the headboard in the rearward position, with and without a mattress.

Figure 9:
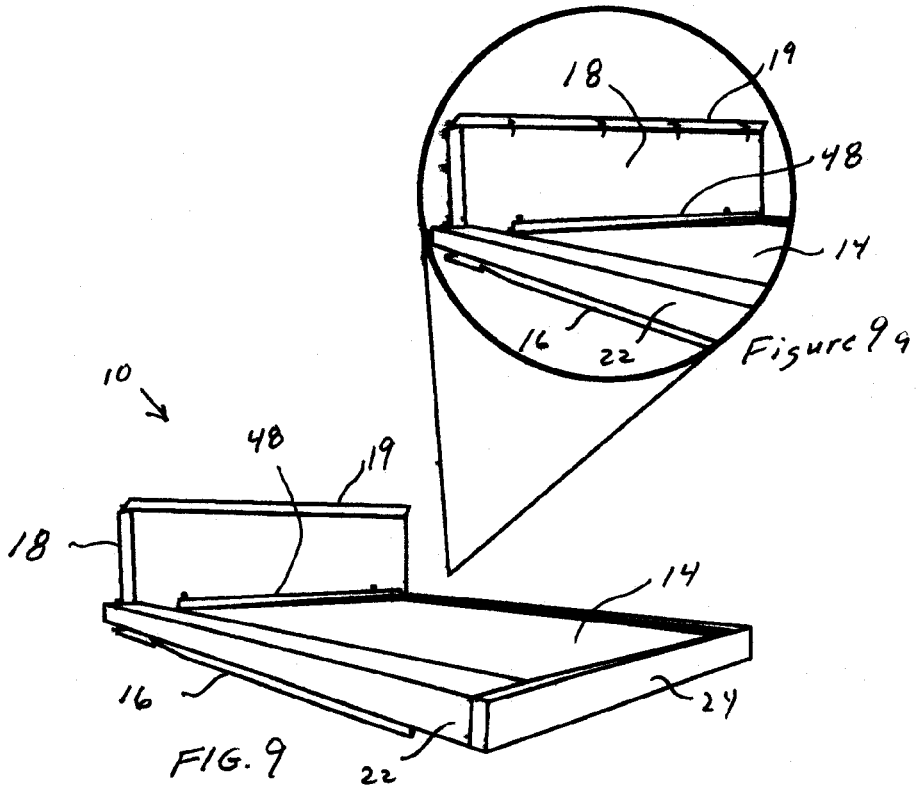

FIGS. 9 and 9*a* are perspective views of the pull down bed of FIG. 1 shown with the headboard in the forward position, with the headboard top panel in the partially raised position.

Figure 10:
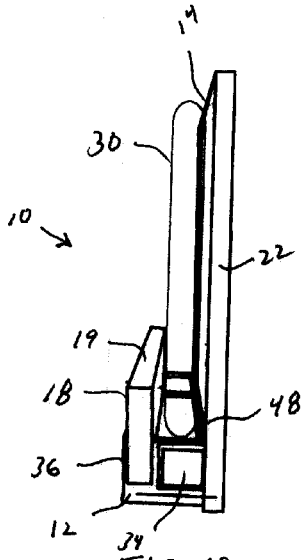

FIG. 10 is a side perspective view of the pull down bed of FIG. 1 in the raised (stored) position with the leg panels folded in and the mattress shown in phantom.

Figure 11:
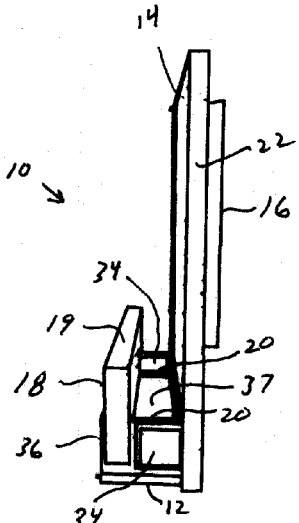

FIG. 11 is a side perspective view of the pull down bed of FIG. 1 in the raised (stored) position with the leg panels folded out.

Figure 12:
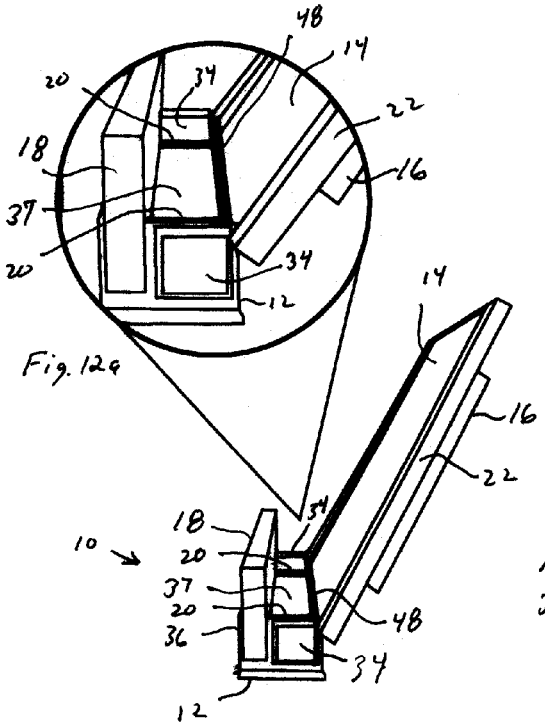

FIGS. 12 and 12*a* are side perspective views of the pull down bed of FIG. 1 in the partially lowered position with the leg panels folded out.

Figure 13:
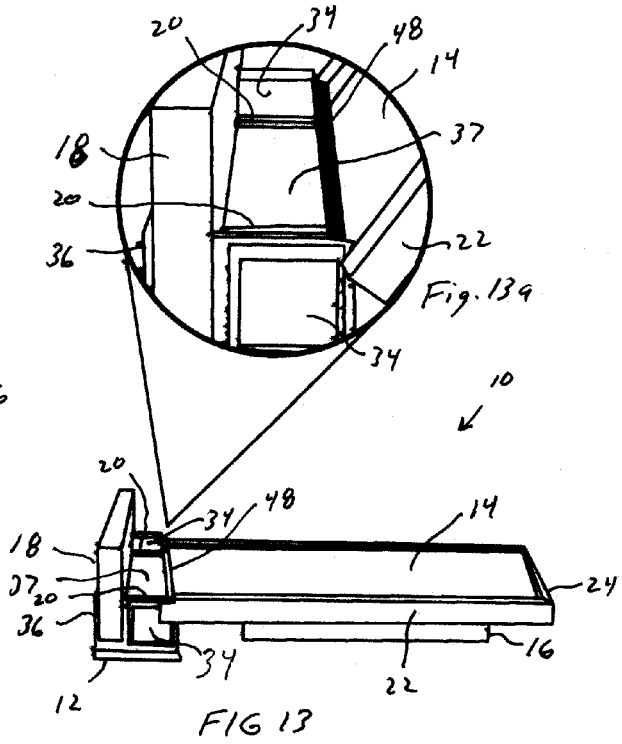

FIGS. 13 and 13*a* are side perspective views of the pull down bed of FIG. 1 in the lowered (use) position with the headboard in the rearward position.

Figure 14:
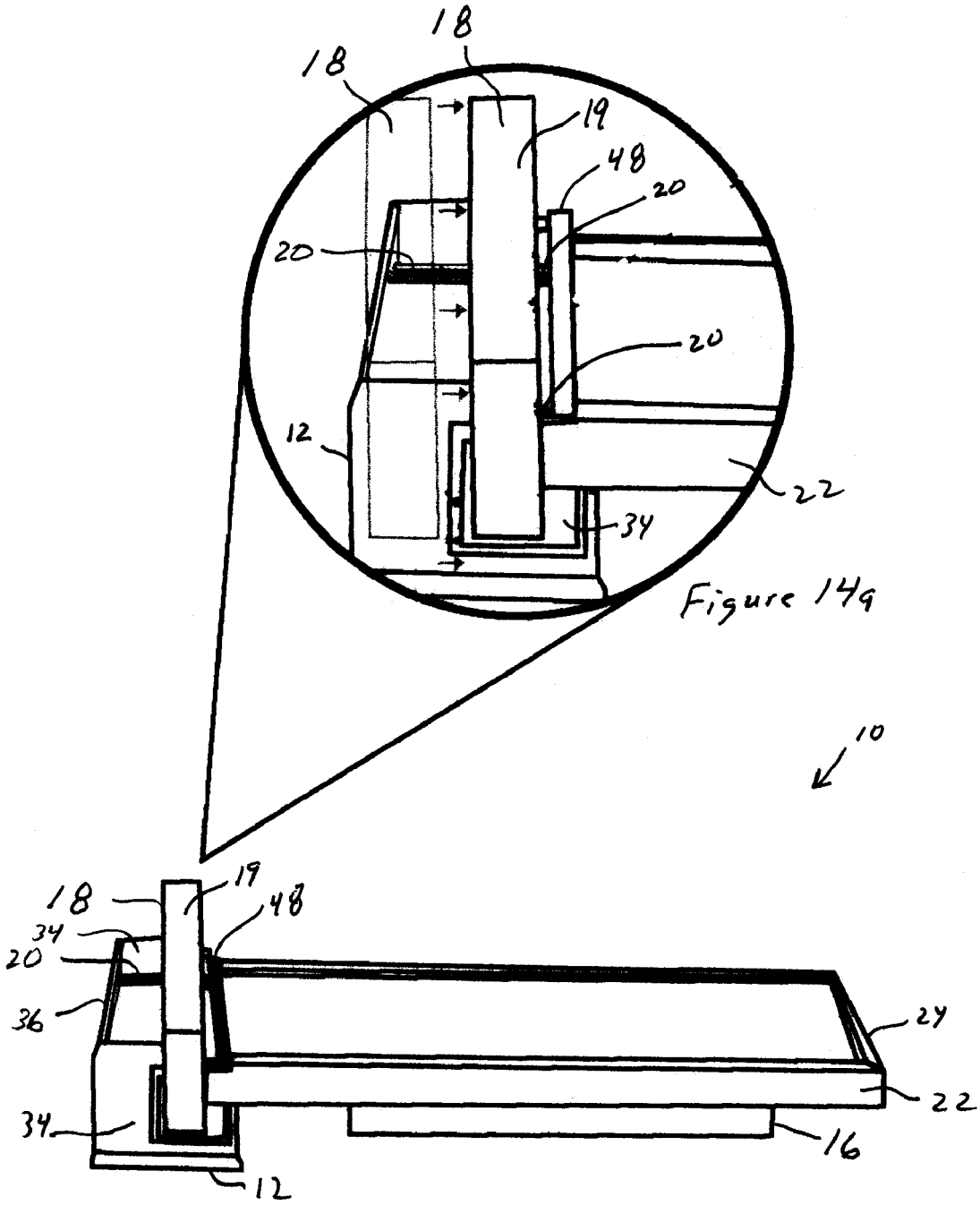

FIGS. 14 and 14*a* are side perspective views of the pull down bed of FIG. 1 in the lowered (use) position with the headboard in the forward position.

DETAILED DESCRIPTION OF THE INVENTION

The present invention is a pull down bed (a.k.a. "folding bed" or "wall bed") of the type popularized by The Murphy Bed Company in the early part of the twentieth century. That is, the present invention is a pull down bed that pivots from a vertical, stow away position to a horizontal position for use when sleeping.

Referring to the drawings, there is shown in FIGS. 1-14 a pull down bed 10 comprising a stationary base portion 12, a mattress platform 14, leg panels 16 and a headboard 18. The mattress platform 14 is anchored to the base 12 and pivots about an axis that transects the base portion 12 when the platform 14 is moved between vertical (stowed) and horizontal (use) positions. The mattress 30 rests directly on the mattress platform 14 and is secured thereto with straps. When the bed 10 is in the stored position (FIG. 10) the mattress 30 nests between the headboard 18 and the platform 14.

The pull down bed 10 lacks the "above-bed" support structure often seen in conventional pull down beds above and behind the headboard when in the down (use) position. Consequently, when the bed 10 is in the down position it has the look of a traditional, everyday bed as shown in FIG. 1. This "traditional" looks is further achieved by placing the raising and lowering mechanism within the stationary base 12.

The base 12 preferably is secured to a floor, although it can be mounted to a wall. The base 12 can be mounted to the floor or wall in any suitable fashion, such as with screws. The base 12 comprises opposing side panels 34, a rear wall 36, and a horizontal panel 37 extending between the side panels 34 at a height about the same as the mattress platform 14.

Figure 2:
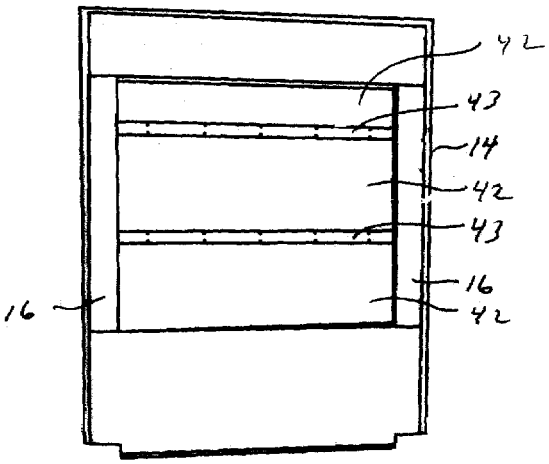
Figure 3A:
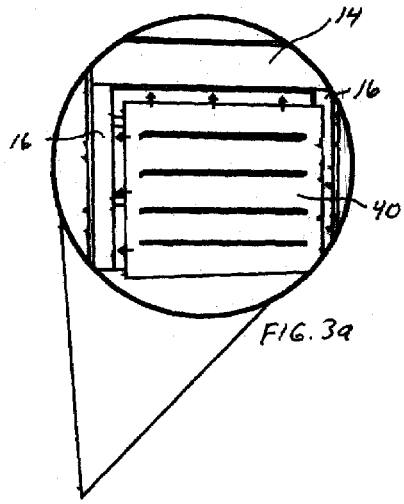
Figure 3:
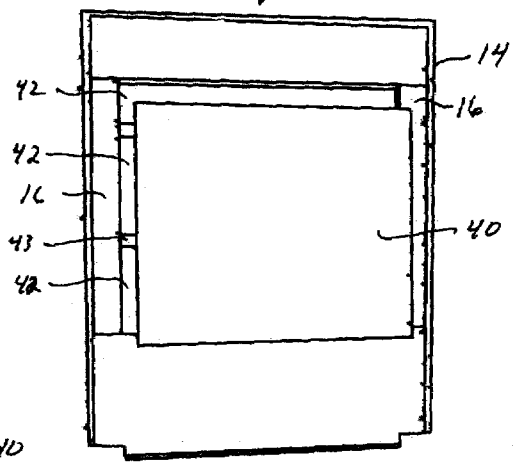
Figure 4:
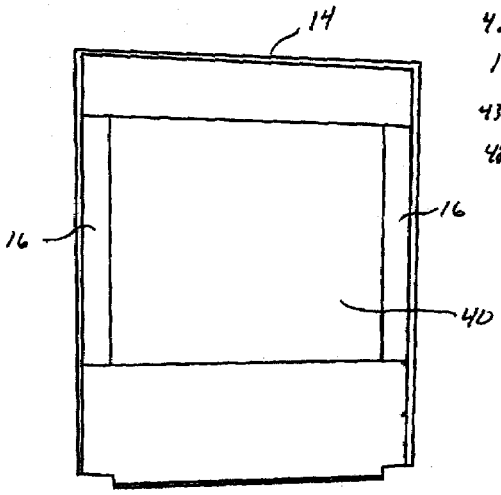
FIG. 4 is a perspective view of the mattress platform portion of FIG. 2 shown with the decorative snap-on panel installed.

As best shown in FIGS. 2-4, the mattress platform 14 comprises a series of mattress panels 42 connected together and reinforced with steel T-bar 43 along its width and supported by aluminum hat bar along its length. The steel and aluminum backing allows the bed 10 to support the weight on and within the platform 14 and keeps construction costs low. For aesthetic purposes a snap-on bottom panel 40 can be affixed to the bottom of the mattress platform as shown in FIGS. 3 and 4.

A mattress backboard 48 attached to the platform 14 near the platform head serves as a stop to prevent the mattress 30 from sliding down past the backboard 48 when the bed 10 is in the raised position (FIG. 10). Straps (not shown) help secure the mattress 30 to the platform 14.

Cosmetic side and foot covering panels 22, 24 snap onto and add some structural integrity to the mattress platform 14. The covering panels 22, 24 may be affixed to the sides and the foot respectively of the mattress platform 14 in any suitable manner, preferably by an interference fit. The covering panels 22, 24 can be changed by the bed owner when a change in déor is desired.

The mechanism that allows the platform 14 to be raised and lowered is conventional in design, and may comprise springs or struts.

Figure 5:
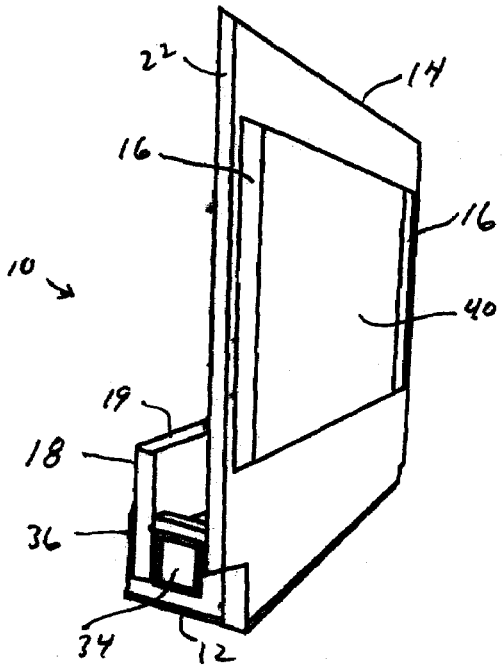
Figure 6:
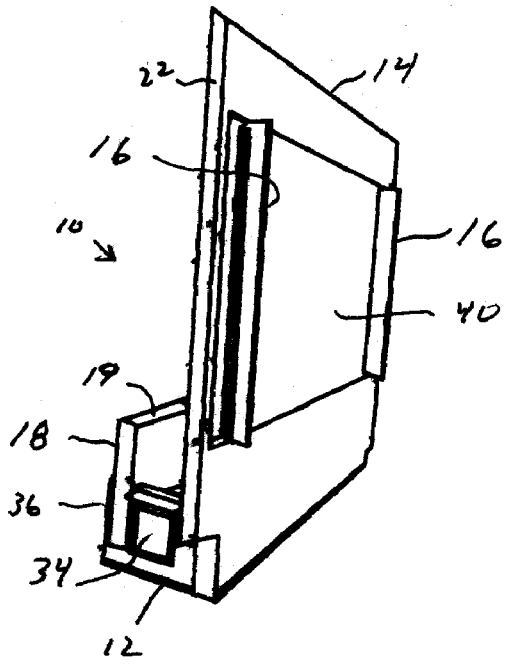
FIG. 6 is a side perspective view of the pull down bed of FIG. 1 in the raised (stored) position with the leg panels folded out.
Figure 7:
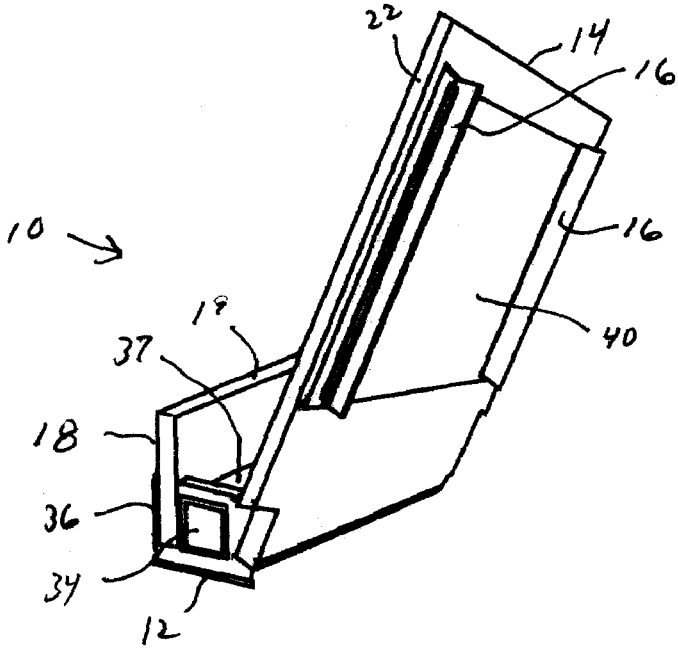
FIG. 7 is a side perspective view of the pull down bed of FIG. 1 in a partially lowered position.

In a key feature of the invention, the leg panels 16 are hingedly attached to the platform 14 as best shown in FIGS. 5-7. Each leg panel 16 swings outward against the platform 14 when the bed 10 is stowed in a vertical position. When the bed 10 is in the lowered, horizontal position the leg panels 16 pivot inward, away from the platform sides and lock at a 90 degree angle to the platform 14 to bear the weight of the platform 14. Preferably the leg panels extend at least half the length of the mattress platform 14 as shown in FIG. 14. In the lowered position shown in FIGS. 1, 8, 9, 13 and 14 the leg panels 16 are recessed under the mattress platform 14 to give the platform 14 an attractive floating appearance.

In another key feature of the invention, the headboard 18 is slidably mounted on parallel horizontal rails 20 affixed to the base horizontal panel 37. FIGS. 5-8 and 10-13 show the rearward position of the headboard 18 when the bed 10 is stored. When the bed 10 is first pulled down the headboard 18 remains in a rearward position as shown in FIG. 12. The headboard 18 can then be manually slid forward toward the mattress 30 to provide a more traditional bed look, as shown in FIG. 14. When the headboard 18 is slid forward it is separated from the mattress by a small gap of about a few inches. Before raising the bed 10, the headboard must be slid rearward on the rails 20.

As best shown in FIG. 9, the headboard 18 can include storage space within the headboard 18 that is accessed through a hinged top panel 19. The headboard depth can be increased to accommodate larger items such as pillows and quilts.

It is to be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim:

1. A pull down bed comprising:

a stationary base mountable to a wall or floor, the base comprising a pair of opposing side walls and a horizontal panel extending between the side walls;

a mattress platform having a head end, a foot end, sides and upper and lower surfaces, the mattress platform being pivotally attached to the stationary base so that the mattress platform can be raised and lowered between a vertical, stowaway position and a horizontal, use position;

one or more rails attached to the horizontal panel; and a headboard mounted on the rails such that the headboard can slide horizontally along the rails independent of the mattress platform between a rearward position when the mattress platform is raised and a forward position when the mattress platform is lowered.

2. The pull down bed of claim 1 further comprising cosmetic panels attached to the mattress platform sides and foot end.

3. The pull down bed of claim 1 further comprising a mattress that nests between the platform and the headboard when the bed is in the vertical position.

4. The pull down bed of claim 1 further comprising a bottom panel removably attached to the platform.

5. The pull down bed of claim 1 wherein the headboard comprises internal storage space and a top panel that can be opened to allow access to the storage space.

6. The pull down bed of claim 5 wherein the headboard top panel is hingedly attached to the headboard.

7. A pull down bed comprising:

a stationary base mountable to a wall or floor;

a mattress platform having a head end, a foot end, sides and upper and lower surfaces, the mattress platform being pivotally attached to the stationary base so that the platform can be raised and lowered between a vertical, stowaway position and a horizontal, use position; and a pair of leg panels hingedly attached to the lower surface of the mattress platform such that each leg panel can pivot about an axis parallel to the mattress platform sides between a folded, stowaway, position and a vertical, use position, the leg panels being load bearing when in the vertical position, wherein the leg panels pivot inwardly, toward each other, and are recessed under the platform away from the platform sides when in the vertical, use position to give the platform a floating appearance when the platform is in the horizontal position.

* * * * *